US006035839A

United States Patent [19]

Ohtani et al.

[11] Patent Number: 6,035,839

[45] Date of Patent: Mar. 14, 2000

[54] METHOD AND APPARATUS FOR CONTROLLING THE AIR-FUEL RATIO OF AN INTERNAL COMBUSTION ENGINE

[75] Inventors: Seiichi Ohtani; Mitsuru Miyata; Masanobu Osaki, all of Atsugi, Japan

[73] Assignee: Unisia Jecs Corporation, Kanagawa-ken, Japan

[21] Appl. No.: 08/982,071

[22] Filed: Dec. 1, 1997

[30] Foreign Application Priority Data

Dec. 4, 1996 [JP] Japan ..... 8-324235

[51] Int. Cl.[7] ..... F02D 41/14

[52] U.S. Cl. ..... 123/685

[58] Field of Search ..... 123/685, 686, 123/689, 696, 479, 440

[56] References Cited

U.S. PATENT DOCUMENTS

| | | | |
|---|---|---|---|
| 4,763,628 | 8/1988 | Mieno et al. | 123/440 |
| 5,048,490 | 9/1991 | Nakaniwa | 123/479 |
| 5,445,136 | 8/1995 | Yamashita et al. | 123/689 |
| 5,462,039 | 10/1995 | Mamiya et al. | 123/686 |

FOREIGN PATENT DOCUMENTS 5-33706 2/1993 Japan .

*Primary Examiner*—Henry C. Yuen
*Assistant Examiner*—Mahmoud M. Gimie
*Attorney, Agent, or Firm*—McDermott, Will & Emery

[57] ABSTRACT

An object of the present invention is to be able to correct for deviation of an actual air-fuel ratio from a point for satisfactory purification performance of an exhaust gas purification catalytic converter, during an interval from immediately after start up until an air-fuel ratio sensor and an exhaust gas purification catalytic converter attain a stable condition. To achieve this, a control constant in an air-fuel ratio feedback control is set and altered during an interval from immediately after start up until the air-fuel ratio sensor and the exhaust gas purification catalytic converter attain a stable condition. In this way, the actual air-fuel ratio can be shifted, and hence the deviation of the actual air-fuel ratio from the point for satisfactory purification performance of the exhaust gas purification catalytic converter during the interval from immediately after start up until the air-fuel ratio sensor and the exhaust gas purification catalytic converter attain a stable condition, can be corrected. Consequently, the situation immediately after start up where the actual air-fuel ratio deviates from the target air-fuel ratio, attributable to the air-fuel ratio sensor and the exhaust gas purification catalytic converter being in an unstable condition, can be suppressed. Therefore the purification efficiency of the exhaust gas purification catalytic converter can be kept high.

12 Claims, 6 Drawing Sheets

METHOD AND APPARATUS FOR CONTROLLING THE AIR-FUEL RATIO OF AN INTERNAL COMBUSTION ENGINE

1. FIELD OF THE INVENTION

The present invention relates to a method and apparatus for controlling the air-fuel ratio of an internal combustion engine. In particular the invention relates to improvements in techniques for air-fuel ratio feedback control using an air-fuel ratio sensor.

2. DESCRIPTION OF THE RELATED ART

Conventionally, the purification performance of a three-way catalytic converter is optimized by controlling the air-fuel ratio (A/F) of the mixture drawn into the engine, to a three-way point (for example close to the theoretical air fuel ratio). As a result, discharge of the noxious components (NOx, CO, HC) in the exhaust is kept to a minimum. As a means for controlling the air-fuel ratio of the engine intake mixture to the three-way point, there is known for example an air-fuel ratio feedback control (F/B control) which increasingly or decreasingly corrects an air-fuel ratio control quantity (for example fuel injection quantity or intake air flow quantity) based on a rich-lean inversion signal corresponding to the oxygen concentration in the exhaust sensed by an oxygen sensor (Japanese Unexamined Patent Publication No. 5-33706).

However immediately after start up, irrespective of whether or not the engine is cooled down or warmed up, there is a situation during an interval until the oxygen sensor and the three-way catalytic converter become stable, where a deviation occurs between the actual air-fuel ratio and the value detected by the oxygen sensor (detection result). The air-fuel ratio (A/F) of the engine intake mixture thus deviates from the three-way point (target air-fuel ratio).

In such a case, with the conventional air-fuel ratio feedback control, since the engine operates with the air-fuel ratio of the engine intake mixture deviated from the three-way point of the three-way catalytic converter, there is the likelihood of a collapse in the purification balance for the NOx, CO, HC, and a consequent deterioration of emissions.

That is to say, since the control constant (so called proportional constant (P) or integral constant (I)) for the air-fuel ratio feedback control is set so that under normal operating conditions (oxygen sensor and three-way catalytic converter in a stable condition), the air-fuel ratio (A/F) of the engine intake mixture is suitably controlled to the three-way point, then in the situation immediately after start up where the condition of the oxygen sensor and the three-way catalytic converter is unstable, the control constant becomes unmatched, and hence the air-fuel ratio (A/F) of the engine intake mixture cannot be suitably controlled to the three-way point. There is thus the likelihood of a deterioration in emissions.

SUMMARY OF THE INVENTION

The present invention takes into consideration the above situation with the conventional arrangement, with the object of being able to correct for deviation of the actual air-fuel ratio of the engine intake mixture from a satisfactory purification performance point (the three-way point in the case of a three-way catalytic converter) of the exhaust gas purification catalytic converter, during an interval from immediately after start up until the air-fuel ratio sensor and the exhaust gas purification catalytic converter attain a stable condition, thus enabling satisfactory air-fuel ratio feedback control to be carried out from immediately after start up.

Accordingly, with the method and apparatus for controlling the air-fuel ratio of an internal combustion engine according to the present invention, air-fuel ratio feedback control involving increasingly or decreasingly correcting an air-fuel ratio control amount based on detection results of an air-fuel ratio sensor is carried out so that an air-fuel ratio of an engine intake mixture becomes a target air-fuel ratio. However, after start up, the target air-fuel ratio is shifted by a predetermined amount during an interval until performance of the air-fuel ratio sensor becomes stable.

With the present invention incorporating such a construction, then during the interval after start up when the performance of the air-fuel ratio sensor is unstable, it is possible to alter the air-fuel ratio feedback control center (the target air-fuel ratio; for example a value which can be achieved even if the control gain is altered). Therefore the situation as with the conventional arrangement wherein operation is carried out after start up, under conditions with the air-fuel ratio (A/F) of the engine intake mixture deviated from the satisfactory purification point of the exhaust gas purification catalytic converter (attributable to the performance of the air-fuel ratio sensor being unstable) can be controlled. Hence deterioration in emissions can be suppressed.

In the case where an air-fuel ratio sensor is disposed upstream of an exhaust gas purification catalytic converter, air-fuel ratio feedback control involving increasingly or decreasingly correcting an air-fuel ratio control amount based on detection results of the air-fuel ratio sensor is carried out so that an air-fuel ratio of an engine intake mixture becomes a target air-fuel ratio. However, after start up, the target air-fuel ratio is shifted by a predetermined amount during an interval until performance of the exhaust gas purification catalytic converter becomes stable.

With such a construction, then during the interval after start up when the performance of the exhaust gas purification catalytic converter is unstable, it is possible to alter the air-fuel ratio feedback control control center (the target air-fuel ratio; for example a value which can be achieved even if the control gain is altered). Therefore the situation as with the conventional arrangement wherein operation is carried out after start up, under conditions with the air-fuel ratio (A/F) of the engine intake mixture deviated from the satisfactory purification point of the exhaust gas purification catalytic converter (attributable to the performance of the exhaust gas purification catalytic converter being unstable) can be controlled. Hence deterioration in emissions can be suppressed.

Moreover, in the case where an air-fuel ratio sensor is disposed upstream of an exhaust gas purification catalytic converter, air-fuel ratio feedback control involving increasingly or decreasingly correcting an air-fuel ratio control amount based on detection results of the air-fuel ratio sensor is carried out so that an air-fuel ratio of an engine intake mixture becomes a target air-fuel ratio. However, after start up, the target air-fuel ratio is shifted by a predetermined amount during an interval until performance of the air-fuel ratio sensor becomes stable, and in addition, after start up, the beforementioned target air-fuel ratio or a target air-fuel ratio shifted by the predetermined amount is further shifted by a predetermined amount during an interval until performance of the exhaust gas purification catalytic converter becomes stable.

With such a construction, then during the interval after start up when the performance of the air-fuel ratio sensor is unstable, and during the interval after start up when the performance of the exhaust gas purification catalytic converter is unstable, it is possible to alter the air-fuel ratio feedback control control center (the target air-fuel ratio; for example a value which can be achieved even if the control gain is altered). Therefore the situation as with the conventional arrangement wherein operation is carried out after start up, under conditions with the air-fuel ratio (A/F) of the engine intake mixture deviated from the satisfactory purification point of the exhaust gas purification catalytic converter (attributable to the performance of the air-fuel ratio sensor or the exhaust gas purification catalytic converter being unstable) can be controlled. Hence deterioration in emissions can be suppressed.

The shift in the target air-fuel ratio can be achieved by alteration of a control gain in the air-fuel ratio feedback control.

If this is done, then for example it is possible to suppress the occurrence of a sudden difference in the air-fuel ratio such as occurs in the case where a reference value for the air-fuel ratio feedback correction amount is altered. Moreover the control logic can be simplified.

Furthermore, regarding the alteration of the control gain in the air-fuel ratio feedback control, the arrangement may be such that the size of a proportional constant (P) on a lean side and on a rich side is made different.

If this is done, then compared to the case where the integral constant (I) is altered, compatibility of the control response and the control stabilization can also be realized, while achieving simplification of the control logic.

Moreover, the shift amount of the target air-fuel ratio may be variably set based on the engine temperature at start up.

If this is done, then control corresponding to start up engine temperature becomes possible. Hence air-fuel ratio feedback control accuracy can be further improved, and deterioration in emissions further suppressed.

The interval from after start up until performance of the air-fuel ratio sensor becomes stable, or the interval from after start up until performance of the exhaust gas purification catalytic converter becomes stable, may be detected based on an elapsed time from start up.

If this is done, then the interval from after start up until the performance of the air-fuel ratio sensor or the exhaust gas catalytic converter becomes stable can be accurately detected with a simple construction.

The construction may be such that the direction of shift of the target air-fuel ratio is in a rich direction relative to the target air-fuel ratio.

With this construction, the actual air-fuel ratio of the mixture drawn into the engine is corrected towards the rich side. Hence, with the general case where a three-way catalytic converter is used as the exhaust gas purification catalytic converter, it is possible to suppress the likelihood of an increase in the NOx discharge amount due to the air-fuel ratio being made leaner after start up so that it deviates from the three-way point at which the NOx, CO, HC can all be satisfactorily purified.

Other aspects and objects of the present invention will become apparent from the following description of embodiment, given in conjunction with the appended drawings.

DETAILED DESCRIPTION OF THE PREFERRED EMBODIMENT

As follows is a description of an embodiment of the present invention based on the appended drawings.

Figure 1:
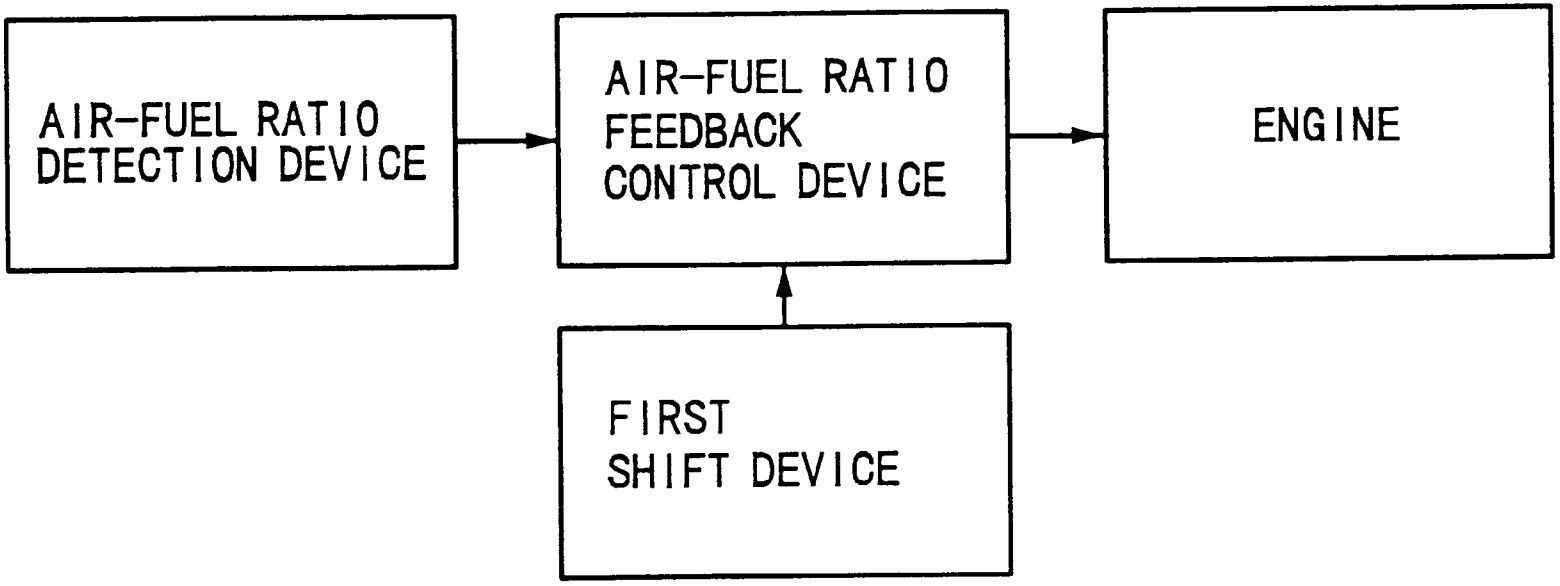
FIG. 1 is a block diagram showing a construction of the present invention.
Figure 2:
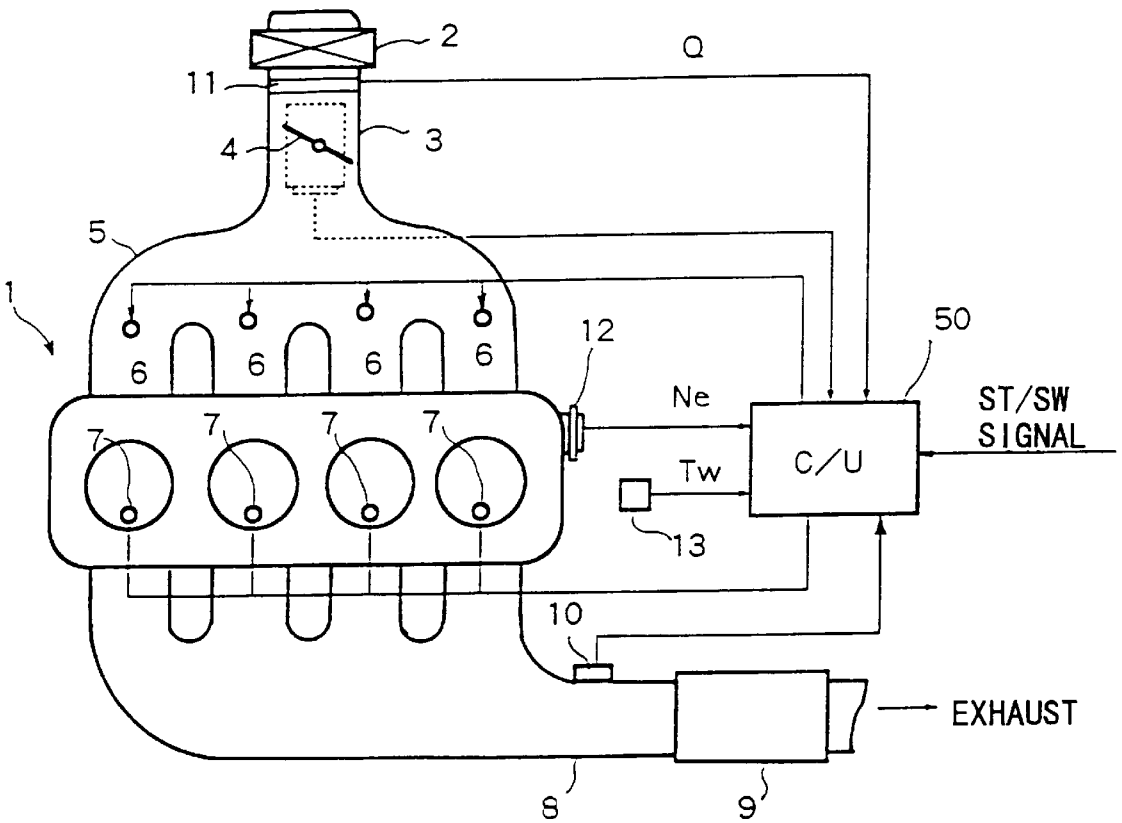
FIG. 2 is a schematic system diagram of an embodiment of the present invention.

In FIG. 2, an engine 1 draws in air from an air cleaner 2 by way of an intake duct 3, a throttle valve 4, and an intake manifold 5. Fuel injection valves 6 are provided for each cylinder, in respective branch portions of the intake manifold 5. The fuel injection valves 6 are solenoid type fuel injection valves which open with power to a solenoid and close with power shut-off. When the fuel injection valves 6 are driven open in response to a drive pulse signal from a control unit 50 (to be described later), fuel which is pumped from a fuel pump (not shown), and which is controlled to a predetermined pressure by means of a pressure regulator (not shown), is injected in a predetermined amount to the engine 1.

Ignition plugs 7 are provided for each combustion chamber of the engine 1 for spark ignition of a mixture therein. The ignition plugs 7 provide a spark at an ignition timing which is previously set and stored in a ROM of the control unit 50, based on a basic fuel injection pulse width Tp to be described later, and engine rotational speed Ne.

Exhaust from the engine 1 is discharged into the atmosphere by way of an exhaust passage 8, a three-way catalytic converter 9 serving as an exhaust gas purification catalytic converter, and a muffler (not shown). Here the three-way catalytic converter 9 carries out suitable oxidation of the CO and HC and reduction of the NOx in the exhaust, in the vicinity of the theoretical air-fuel ratio, to thereby purify the exhaust gases. With the three-way catalytic converter 9, the target air-fuel ratio is a value close to the theoretical air-fuel ratio.

An oxygen sensor 10 serving as an air-fuel ratio sensor is provided in the exhaust passage 8. The oxygen sensor 10 outputs a voltage corresponding to the concentration of oxygen in the exhaust, and by comparing this voltage with a previously set slice level SL (for example corresponding to the theoretical air-fuel ratio), then rich/lean judgment of the air-fuel ratio can be carried out.

The control unit 50 incorporates a microcomputer having a CPU, ROM, RAM, A/D converter, input/output interface, timer and so on. The control unit 50 receives input signals from various sensors and carries out computational processing (as described later) to thereby control the injection quantity (that is, the air-fuel ratio control quantity ) of the fuel injection valves 6.

For the various sensors in addition to the oxygen sensor 10, there is provided in the intake duct 3, an airflow meter 11 which outputs a signal corresponding to the intake air quantity Q of the engine 1.

Furthermore, a crank angle sensor 12 is provided on the crank shaft or cam shaft of the engine 1, and engine rotational speed N is detected by counting the number of unit crank angle signals output from the crank angle sensor 12 in synchronous with the engine rotation over a constant period, or by measuring a period of a reference crank angle signal.

A water temperature sensor 13 serving as an engine temperature detection device, is provided facing into the cooling jacket of the engine 1, for detecting a cooling water temperature Tw. A start switch signal (ST/SW, starter motor on/off signal) from a key switch SW 14 is also input to the control unit 50.

The control unit 50 computes a basic fuel injection pulse width Tp (corresponding to the fuel injection quantity), from the intake air quantity Q obtained from a voltage signal from the airflow meter 11, and the engine rotational speed N obtained from a signal from the crank angle sensor 12 ($Tp=c\times Q/N$, where c is a constant). Moreover the control unit 50 computes an optimum effective fuel injection pulse width Ti, from a water temperature correction coefficient Kw for forcible correction to the rich side at the time of low water temperature, a start up and post start up increment amount correction coefficient Kas, an air-fuel ratio feed back correction coefficient $\alpha$, and so on. ($Ti=Tp\times(1+Kw+Kas+\ldots)\times\alpha$. The optimum effective fuel injection pulse width Ti is then sent as a drive pulse signal to the fuel injection valves 6, to thereby inject fuel which has been adjusted to a predetermined amount.

Figure 5:
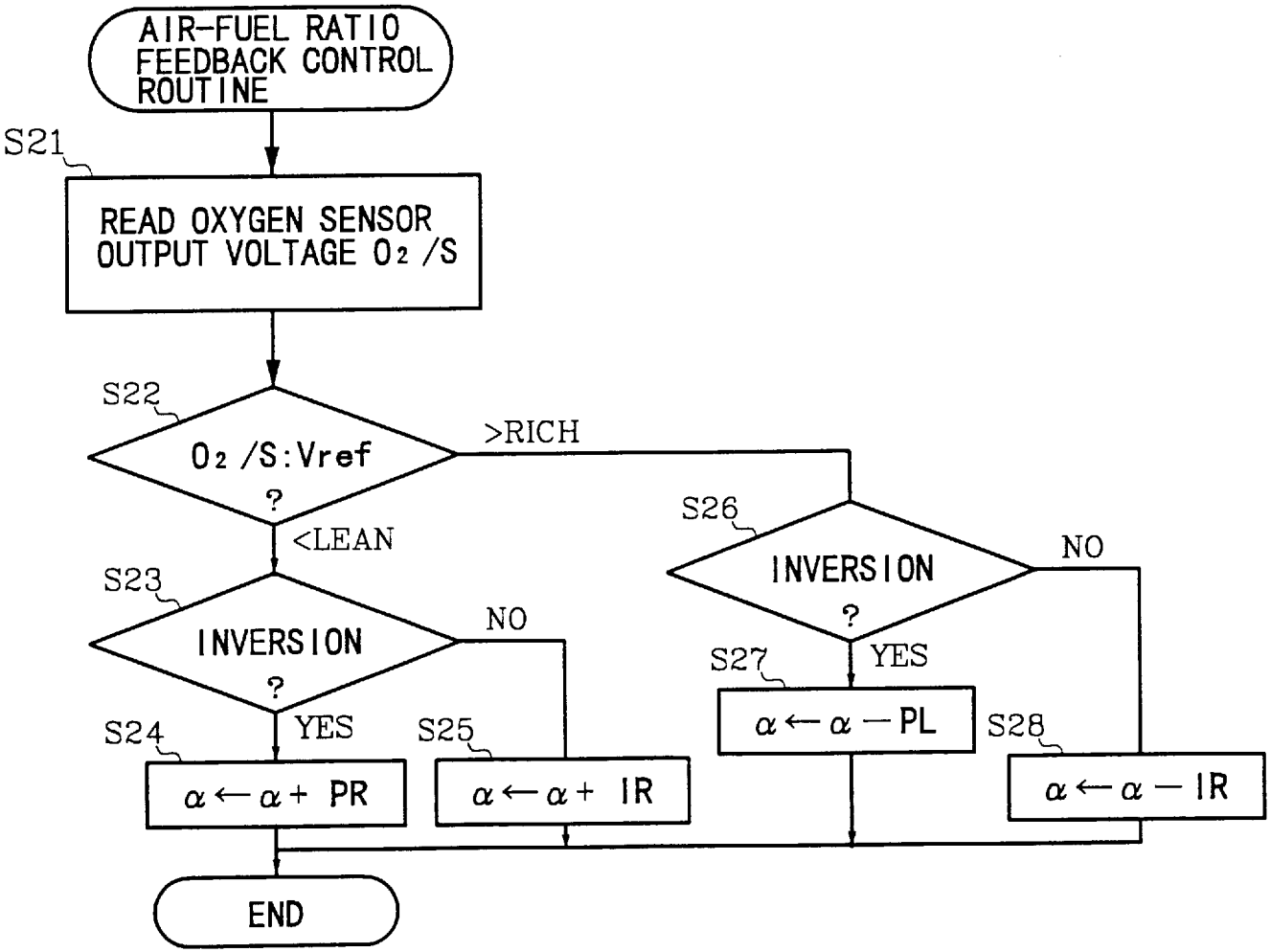
FIG. 5 is a flow chart for explaining an air-fuel ratio feedback control according to the embodiment.

The above mentioned air-fuel ratio feedback correction coefficient a, as described by the flow chart of FIG. 5 to be discussed later, is increased or decreased by a proportional-integral (PI) control based on a rich-lean inversion output from the oxygen sensor 10. Then based on this coefficient, the basic fuel injection pulse width Tp is corrected by the control unit 50, thereby feedback controlling the air-fuel ratio of the combustion mixture to approach the target air-fuel ratio (theoretical air-fuel ratio).

A description will now be given with reference to the flow chart of FIG. 3, of the air-fuel ratio control immediately after start up (the control for setting the control constant of the air-fuel ratio feedback control), carried out by the control unit 50 which functions according to the present invention as a first shift step or device, a second shift step or device, and a third shift step or device. Although there are differences in specification or type of the oxygen sensor, the catalytic converter, or the engine. However from experimental results the common case (the case where the air-fuel ratio is corrected in the lean direction) is where the air-fuel ratio deviates in the lean direction due to the oxygen sensor giving an output immediately after start up which tends to be richer than the actual air-fuel ratio. The description is therefore given here for an example of the case where deviation of the air-fuel ratio towards the lean direction immediately after start up is controlled.

Figure 3:
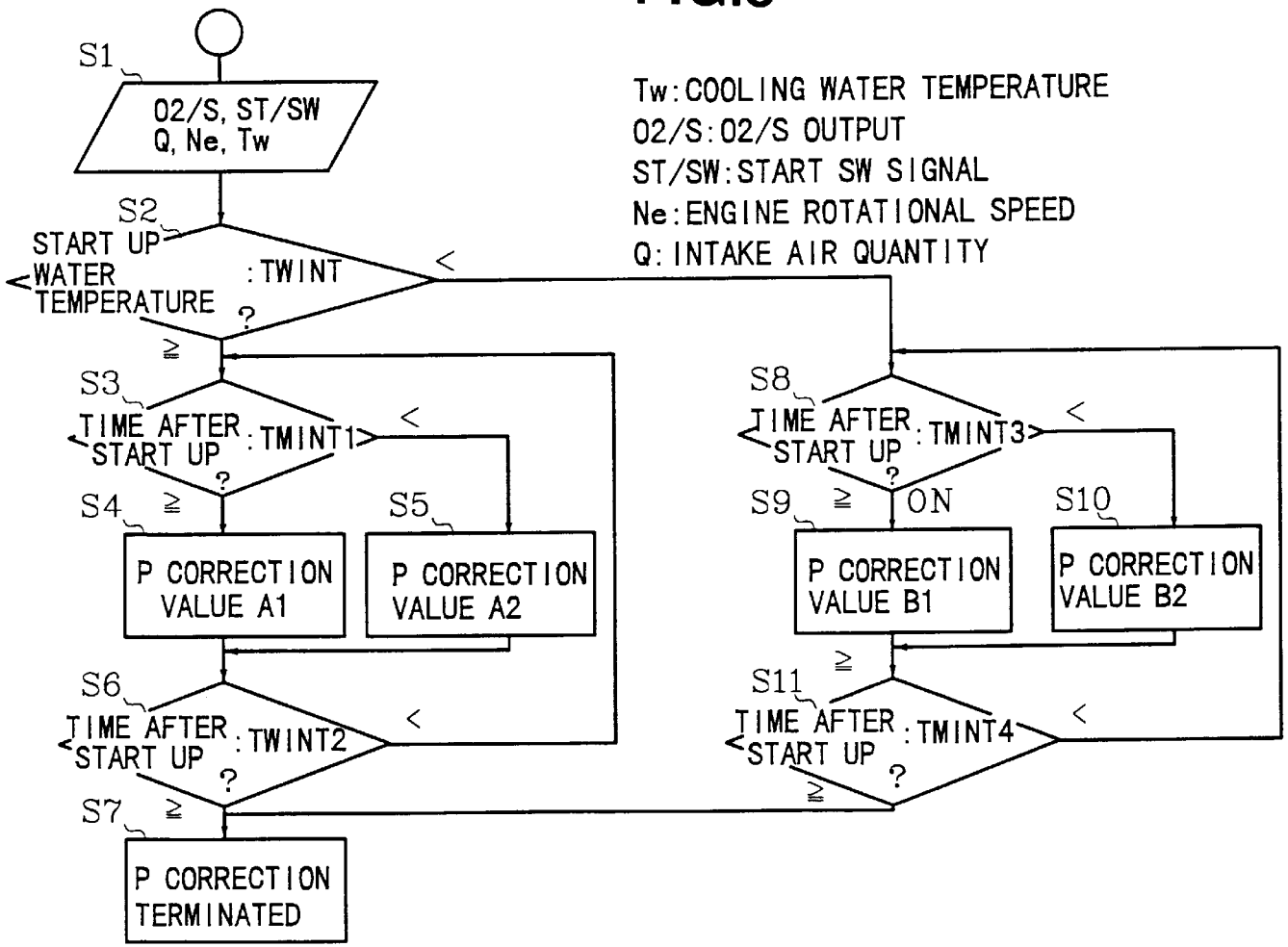
FIG. 3 is a flow chart for explaining an air-fuel ratio control (P correction value setting routine) according to the embodiment.

At first in the flow chart of FIG. 3, in step 1 (with step indicated by S1 in the figures and hereunder), an output signal $O_2/S$ from the oxygen sensor 10, an output signal ST/SW from the start switch SW, an engine rotational speed Ne, an intake air quantity Q, and a water temperature Tw are read.

Then in step 2, a start up water temperature and a predetermined value TWINT are compared. If the start up water temperature ≧TWINT, control proceeds to step 3. On the other hand, if the start up water temperature <TWINT, control proceeds to step 8.

In step 3, an elapsed time after start up (preferably this is made an elapsed time from after the ST/SW has gone off after switching on) and a predetermined value TMINT1 are compared. If the elapsed time after start up ≧TMINT1, control proceeds to step 4. On the other hand, if the elapsed time after start up <TMINT1, control proceeds to step 5.

Figure 4:
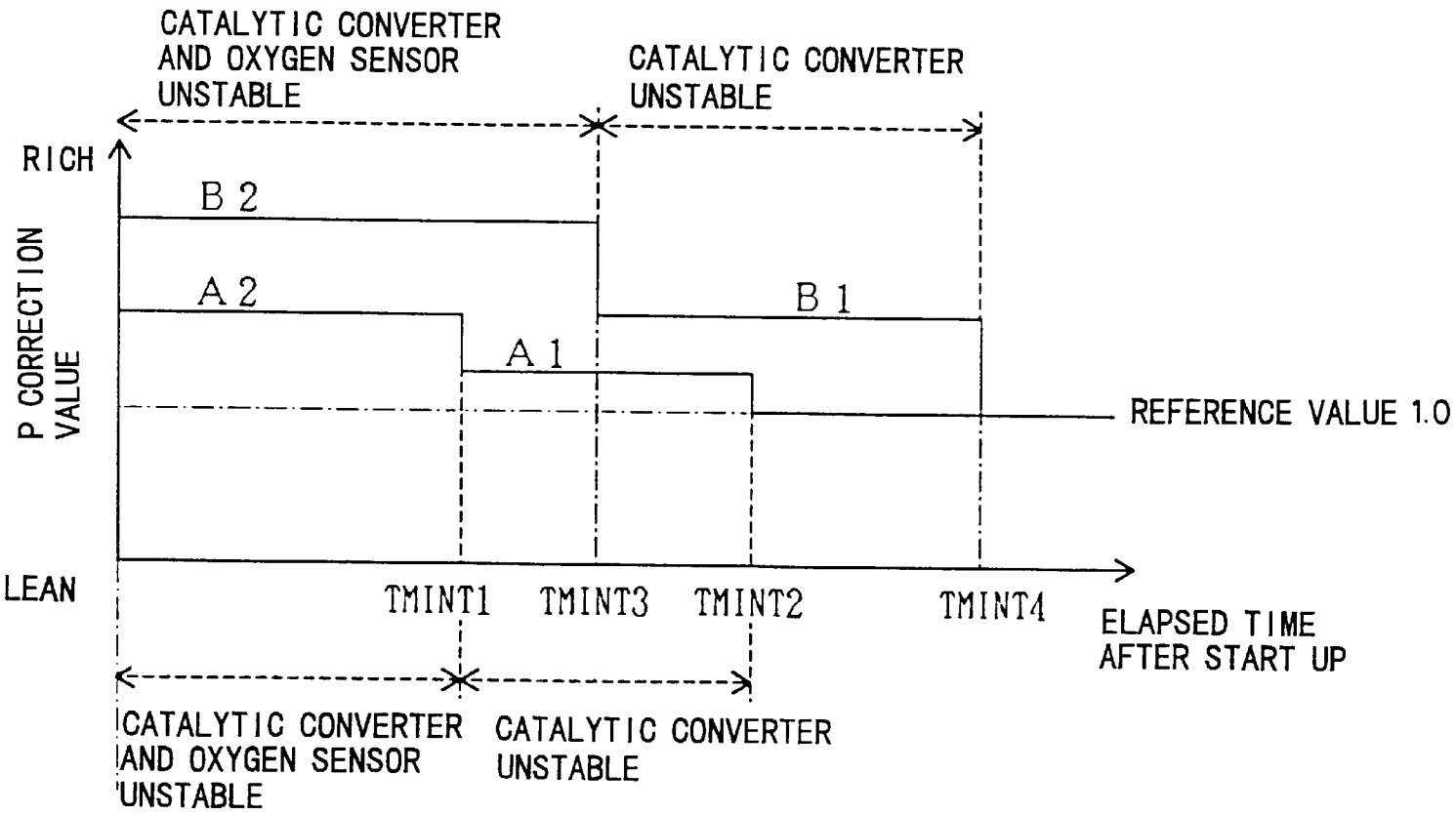
FIG. 4 is a diagram showing an example of a table for setting the P correction value according to the embodiment.

In step 5, since not yet post start up conditions, the lean deviation of the air-fuel ratio is comparatively large since both the oxygen sensor 10 and the three-way catalytic converter 9 are in an unstable condition. A P correction value is therefore set to A2 as shown in FIG. 4, and control then proceeds to step 6.

On the other hand in step 4, a certain amount of time has elapsed since start up. Hence it is judged that the oxygen sensor 10 has stabilized and only the three-way catalytic converter 9 is in an unstable condition. The lean deviation of the air-fuel ratio is thus small and hence as shown in FIG. 4, the P correction value is set to A1, and control proceeds to step 6.

In step 6, the elapsed time after start up and a predetermined value TMINT2 are compared. If the elapsed time after start up ≧TMINT2, then both the oxygen sensor 10 and the three-way catalytic converter 9 are stable. Therefore the lean deviation of the air-fuel ratio no longer exists. Control therefore proceeds to step 7 to terminate the P correction as shown in FIG. 4. On the other hand, if the elapsed time after start up <TMINT2, control returns to step 3 and the routine is repeated.

In step 7, the P correction is terminated and the routine is then terminated.

Referring back to step 2, in the case where it is judged that the start up water temperature <TWINT, then control proceeds to step 8 for low temperature start up. In step 8 the elapsed time after start up and a predetermined value TMINT3 are compared.

If the elapsed time after start up ≧TMINT3, control proceeds to step 9. On the other hand, if the elapsed time after start up <TMINT3, control proceeds to step 10.

In step 10, since there is low temperature start up and not yet post start up conditions, the lean deviation of the air-fuel ratio is large since both the oxygen sensor 10 and the three-way catalytic converter 9 are in an unstable condition. The P correction value is therefore set to B2 as shown in FIG. 4, and control then proceeds to step 11.

On the other hand, in step 9, a certain amount of time has elapsed since start up. Hence it is judged that the oxygen sensor 10 has stabilized and only the three-way catalytic converter 9 is in an unstable condition. The lean deviation of the air-fuel ratio is thus comparatively small and hence as shown in FIG. 4, the P correction value is set to B1, and control proceeds to step 11.

In step 11, the elapsed time after start up and a predetermined value TMINT4 are compared. If the elapsed time after start up ≧TMINT4, then both the oxygen sensor 10 and the three-way catalyst converter 9 are stable. Therefore the lean deviation of the air-fuel ratio no longer exists. Control therefore proceeds to step 7 to terminate the P correction as shown in FIG. 4. On the other hand, if the elapsed time after start up <TMINT4, control returns to step 8 and the routine is repeated.

The P correction values (A1, A2, B1, B2) obtained in the above manner are used in a flow chart of FIG. 5 to be described later, for setting an air-fuel ratio feedback correction coefficient $\alpha$ which is offset immediately after start up. In this way, the air-fuel ratio (A/F) of the engine intake mixture is suitably controlled to a satisfactory exhaust gas purification point (for example a three-way point) of the catalytic converter 9.

Now as shown in FIG. 4, after completion of the P correction, with the present embodiment the P correction value is set to 1.0.

The air-fuel ratio feedback control carried out by the control unit 50 which functions as an air-fuel ratio feedback control device, will now be described according to the flow chart of FIG. 5. The air-fuel ratio feedback control is carried out for each input of the reference signal from the crank angle sensor 12 or at a synchronized time, to thereby set the air-fuel ratio feedback correction coefficient $\alpha$. The beforementioned Ti is then computed using this $\alpha$.

In step 21, the output voltage $O_2/S$ from the oxygen sensor 10 is read.

Then in step 22, the $O_2/S$ and a slice level voltage Vref are compared to thereby judge the leaness or richness of the air-fuel ratio.

When the air-fuel ratio is lean ($O_2/S<Vref$), control proceeds to step 23 where it is judged if there is an inversion from rich to lean (immediately after inversion). In the case of an inversion, control proceeds to step 24.

In step 24, the air-fuel ratio feedback correction coefficient $\alpha$ is increased by a proportional constant PR with respect to the previous value to thereby rapidly correct the air-fuel ratio in the rich direction. The P correction value obtained from the flow chart of FIG. 3 is reflected in the proportional constant PR.

That is to say, the proportional constant PR is set for example corresponding to the engine water temperature and elapsed time after start up according to an equation PR=basic P (=previously determined reference value)×P correction value.

When there is no inversion, control proceeds to step 25 where the air-fuel ratio feedback correction coefficient $\alpha$ is increased by an integral constant IR relative to the previous value, thereby increasing the air-fuel ratio feedback correction coefficient $\alpha$ at a constant slope.

On the other hand, when the air-fuel ratio is rich ($O_2/S>Vref$), control proceeds from step 22 to step 26 where it is judged if there is an inversion from lean to rich (immediately after inversion). In the case of an inversion, control proceeds to step 27.

In step 27, the air-fuel ratio feedback correction coefficient $\alpha$ is decreased by a proportional constant PL with respect to the previous value to thereby rapidly correct the air-fuel ratio in the lean direction. The P correction value obtained from the flow chart of FIG. 3 is reflected in the proportional constant PL.

That is to say, the proportional constant PL is set for example corresponding to the engine water temperature and elapsed time after start up according to an equation PL=basic P (=previously determined reference value)×(2−P correction value).

When there is no inversion, control proceeds to step 28 where the air-fuel ratio feedback correction coefficient $\alpha$ is decreased by a predetermined integral constant IL relative to the previous value, thereby decreasing the air-fuel ratio feedback correction coefficient $\alpha$ at a constant slope.

Figure 6:
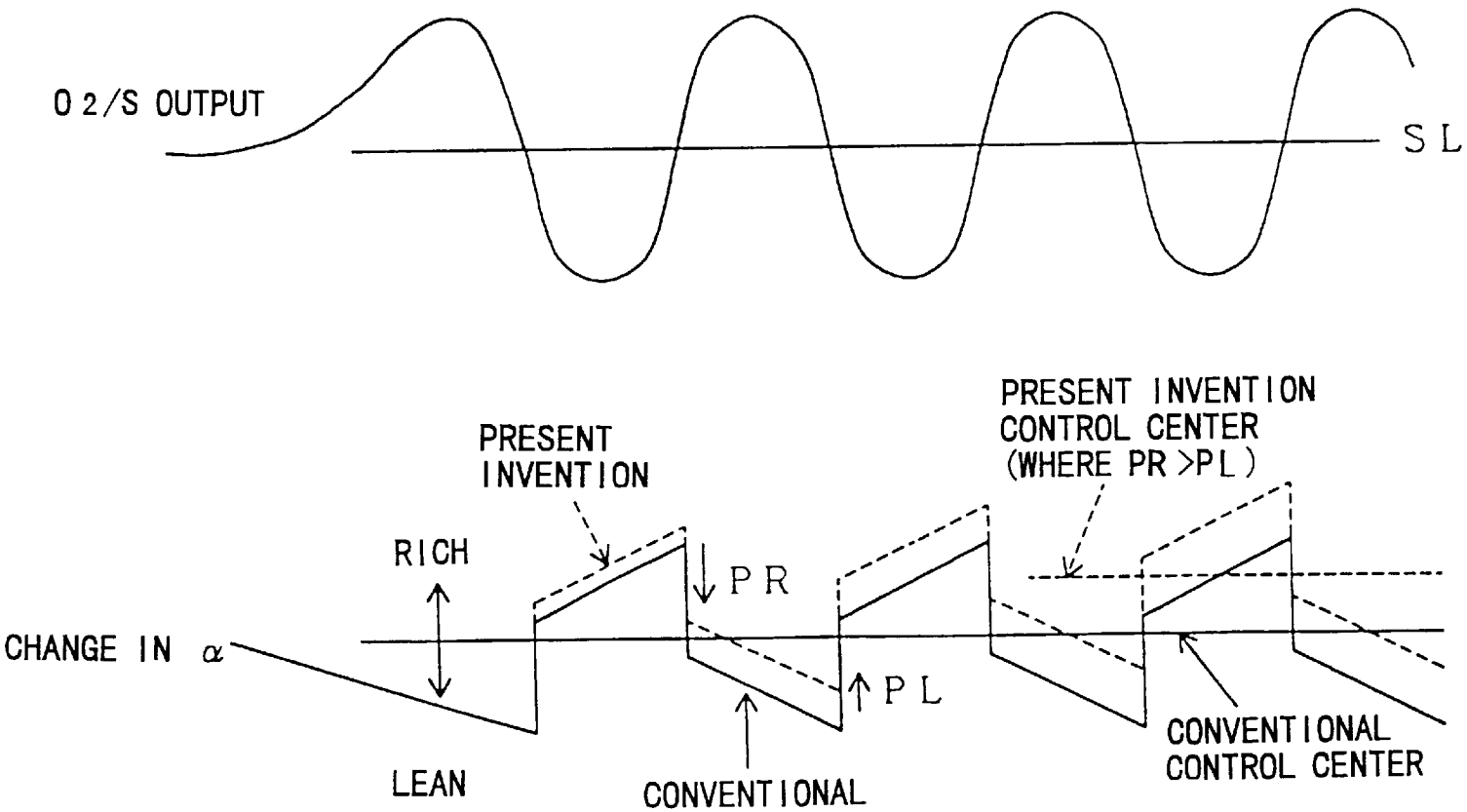
FIG. 6 is a time chart for explaining an operational effect of the embodiment.

When as above, the equation used in step 24 and the equation used in step 27 are used, then if the P correction value is greater than 1, PR becomes greater than PL and hence, due to the rich-lean inversion, the air-fuel ratio moves to become greater in the rich direction. Therefore as shown in FIG. 6 the center for the air-fuel ratio feedback correction coefficient $\alpha$ (air-fuel ratio control center) is subjected to a rich shift. Consequently in the case of a deviation in the actual air-fuel ratio in the lean direction due to the oxygen sensor 10 and the three-way catalytic converter 9 being in an unstable condition immediately after start up, then this deviation can be corrected. Hence it becomes possible to maintain the air-fuel ratio at the satisfactory purification point of three-way catalytic converter 9.

In this way, with the present embodiment, the control constant (here the proportional constant) for the air-fuel ratio feedback control can be corrected immediately after start up, corresponding to engine temperature or elapsed time after start up, and hence operation under conditions where the air-fuel ratio (A/F) of the engine intake mixture deviates from the three-way point of the three-way catalytic converter can be suppressed. Therefore deterioration in emissions can be avoided. Moreover, the amount of deviation of the air-fuel ratio (A/F) of the engine intake mixture from the three-way point of the three-way catalytic converter is reduced in proportion to the increase in the elapsed time after start up. However, since corresponding to this the P correction value can be reduced, then deterioration in emissions resulting from excessive correction due to the P correction can also be suppressed.

Now with the present embodiment, from the view point of compatibility of control response and control stability, and simplification of the control logic, description has been for correction of the proportional constant (P) immediately after start up corresponding to engine water temperature and elapsed time after start up. However it is also possible to correct the integral constant (I). Moreover it is possible to correct both the proportional constant (P) and the integral constant (I).

Furthermore, with the present embodiment, the description has been for correcting the control constant corresponding to the engine water temperature and the elapsed time after start up in order to increase the air-fuel ratio feedback control accuracy. However even if the control constant is corrected corresponding to one or the other, the deviation of the air-fuel ratio (A/F) of the engine intake mixture from the three-way point of the three-way catalytic converter can be suppressed significantly compared to with the conventional air-fuel ratio feedback control. Consequently, the deterioration in emissions can be suppressed.

Moreover, with the present embodiment, the description has been for where an oxygen sensor is used, However, the invention can also be used in the case where a so called wide area air-fuel ratio sensor is used. Furthermore, the invention is not limited to a three-way catalytic converter, and can also be applied to cases where other catalytic converters (oxidation catalyst, NOx reduction catalyst) are used.

We claim:

1. An apparatus for controlling the air-fuel ratio of an internal combustion engine comprising the following means:

air-fuel ratio sensor for detecting an air-fuel ratio of a combustible mixture of an engine;

air-fuel ratio feedback control means for controlling an air-fuel ratio feedback correction coefficient so that a detected value of said air-fuel ratio reaches a target air-fuel ratio;

pulse width correction means for correcting a fuel injection pulse width based on said air-fuel ratio feedback correction coefficient;

correction period detection means for detecting that an elapsed time after engine start up is within a predetermined time; and rich shift means for correcting a control gain of the air-fuel ratio feedback correction coefficient so that the air-fuel ratio is shifted to a rich side, when the elapsed time after engine start up is within the predetermined time.

2. An apparatus for controlling the air-fuel ratio of an internal combustion engine according to claim 1, wherein said air-fuel ratio feedback control means controls said air-fuel ratio feedback correction coefficient by proportional plus integral controls, and wherein said rich shift means corrects the gain of said proportional control so that the air-fuel ratio is shifted to a rich side.

3. An apparatus for controlling the air-fuel of an internal combustion engine according to claim 1, wherein said rich shift; means increases the control gain to shift the air-fuel ratio to a rich side, and decreases the control gain to shift the air-fuel ratio to a lean side.

4. An apparatus for controlling the air-fuel ratio of an internal combustion engine according to claim 1, wherein said rich shift means corrects the control gain of said air-fuel ratio feedback correction coefficient so that the air-fuel ratio is greatly shifted to a rich side when the elapsed time after engine start up is less than the predetermined time.

5. An apparatus for controlling the air-fuel ratio of an internal combustion engine according to claim 1, wherein said rich shift means corrects the control gain of said air-fuel ratio feedback correction coefficient so that the air-fuel ratio is greatly shifted to a rich side when an engine temperature after engine start up is less than a predetermined temperature.

6. An apparatus for controlling the air-fuel ratio of an internal combustion engine according to claim 1, wherein said rich shift means corrects the control gain of said air-fuel ratio feedback correction coefficient so that the air-fuel ratio is greatly shifted to a rich side when elapsed time after engine start up is less than the predetermined time and an engine temperature after engine start up is less than a predetermined temperature.

7. A method of controlling the air-fuel ratio of an internal combustion engine comprising the following steps of:

detecting an air-fuel ratio of a combustible mixture of an engine;

controlling an air-fuel ratio feedback correction coefficient so that a detected value of said air-fuel ratio reaches a target air-fuel ratio;

correcting a fuel injection pulse width based on said air-fuel ratio feedback correction coefficient;

detecting that elapsed time from the engine start up is within a predetermined time; and correcting a control gain of the air-fuel ratio feedback correction coefficient so that the air-fuel ratio is shifted to a rich side, when elapsed time after engine start up is within the predetermined time.

8. A method of controlling the air-fuel of an internal combustion engine according to claim 7, wherein said step of controlling the air-fuel ratio feedback correction coefficient controls said air-fuel ratio feedback correction coefficient by proportional plus integral controls, and wherein said step of correcting the control gain of the air-fuel ratio feedback correction coefficient corrects the gain of said proportional control so that the air-fuel ratio is shifted to a rich side.

9. A method of controlling the air-fuel ratio of an internal combustion engine according to claim 7, wherein said step of correcting the control gain of the air-fuel ratio feedback correction coefficient increases the control gain to shift the air-fuel ratio to a rich side, and decreases the control gain to shift the air-fuel ratio to a lean side.

10. A method of controlling the air-fuel ratio of an internal combustion engine according to claim 7, wherein said step of correcting the control gain of the air-fuel ratio feedback correction coefficient corrects the control gain of said air-fuel ratio feedback correction coefficient so that the air-fuel ratio is greatly shifted to a rich side when the elapsed time after engine start up is less that the predetermined time.

11. A method of controlling the air-fuel ratio of an internal combustion engine according to claim 7, wherein said step of correcting the control gain of the air-fuel ratio feedback correction coefficient corrects the control gain of said air-fuel ratio feedback correction coefficient so that the air-fuel ratio is greatly shifted to a rich side when an engine temperature after engine start up is less than a predetermined temperature.

12. A method of controlling the air-fuel ratio of an internal combustion engine according to claim 7, wherein said step of correcting the control gain of the air-fuel ratio feedback correction coefficient corrects the control gain of said air-fuel ratio feedback correction coefficient so that the air-fuel ratio is greatly shifted to a rich side when elapsed time after engine start up is less than the predetermined time and an engine temperature after engine start up is less than a predetermined temperature.

* * * * *